US008382452B2

(12) United States Patent
Richter et al.

(10) Patent No.: US 8,382,452 B2
(45) Date of Patent: Feb. 26, 2013

(54) PUMP ARRANGEMENT COMPRISING A SAFETY VALVE

(75) Inventors: Martin Richter, Munich (DE); Juergen Kruckow, Munich (DE)

(73) Assignee: Fraunhofer-Gesellschaft zur Foerderung der Angewandten Forschung e.V., Munich (DE)

( * ) Notice: Subject to any disclaimer, the term of this patent is extended or adjusted under 35 U.S.C. 154(b) by 322 days.

(21) Appl. No.: 12/743,831

(22) PCT Filed: Nov. 23, 2007

(86) PCT No.: PCT/EP2007/010198

§ 371 (c)(1),
(2), (4) Date: Jun. 16, 2010

(87) PCT Pub. No.: WO2009/065427

PCT Pub. Date: May 28, 2009

(65) Prior Publication Data

US 2010/0290935 A1 Nov. 18, 2010

(51) Int. Cl.
*F04B 17/00* (2006.01)

(52) U.S. Cl. ..... 417/413.1; 417/413.2; 417/413.3; 417/475

(58) Field of Classification Search ..... 417/413.1, 417/413.2, 413.3, 279, 441, 479, 389, 395
See application file for complete search history.

(56) References Cited

U.S. PATENT DOCUMENTS

| | | | | |
|---|---|---|---|---|
| 6,261,066 | B1 | 7/2001 | Linnemann et al. | |
| 6,696,376 | B2 * | 2/2004 | Niwa et al. | 501/103 |
| 6,991,214 | B2 | 1/2006 | Richter | |
| 7,104,768 | B2 * | 9/2006 | Richter et al. | 417/423.2 |
| 2002/0164255 | A1 * | 11/2002 | Burr et al. | 417/363 |
| 2006/0027772 | A1 * | 2/2006 | Richter et al. | 251/129.06 |
| 2006/0122578 | A1 * | 6/2006 | Lord et al. | 604/891.1 |
| 2007/0209574 | A1 | 9/2007 | Hansen et al. | |

FOREIGN PATENT DOCUMENTS

| | | | |
|---|---|---|---|
| DE | 197 19 862 | A1 | 11/1998 |
| DE | 100 48 376 | A1 | 4/2002 |
| DE | 102 38 600 | A1 | 3/2004 |
| WO | 03/099351 | A2 | 12/2003 |
| WO | 2004/081390 | A1 | 9/2004 |

OTHER PUBLICATIONS

Official Communication issued in corresponding International Patent Application No. PCT/EP2007/010198, mailed on Oct. 7, 2010.
Official Communication issued in International Patent Application No. PCT/EP2007/010198, mailed on Feb. 19, 2008.

* cited by examiner

*Primary Examiner* — Charles Freay
*Assistant Examiner* — Ryan Gatzemeyer
(74) *Attorney, Agent, or Firm* — Keating & Bennett, LLP

(57) ABSTRACT

A pump arrangement includes a pump having a pump inlet and a pump outlet, and a safety valve arranged between the pump outlet and an outlet of the pump arrangement and having a valve seat and a valve lid. The valve seat, the pump outlet and the pump inlet are patterned in a first surface of a first integrated part of the pump arrangement, whereas the valve lid is formed in a second integrated part of the pump arrangement. An inlet of the pump arrangement and a fluid region fluidically connected thereto are formed in a third part of the pump arrangement. The second integrated part is arranged between the first integrated part and the third part of the pump arrangement such that a pressure in the fluid region has a closing effect on the safety valve, the pump inlet and the inlet of the pump arrangement being connected fluidically.

14 Claims, 4 Drawing Sheets

PUMP ARRANGEMENT COMPRISING A SAFETY VALVE

BACKGROUND OF THE INVENTION

Embodiments of the invention relate to a pump arrangement and, in particular, to a pump arrangement comprising a safety valve at a pump outlet of a pump.

Diaphragm pumps comprising passive check valves at the pump inlet and the pump outlet are exemplarily known from DE-A-19719862. Peristaltic pumps comprising no active valve are exemplarily known from DE-A-10238600. In particular, the above documents disclose micropumps, which are taken as such pumps the pump volume of which when being actuated once are in a range of microliters or below.

Known micropumps are problematic in that free flow through the pumps may take place when an overpressure or positive pressure is applied to the inlet reservoir which is connected to the respective pump inlet, and there is no operating voltage applied to the pump.

Normally closed self-blocking valves are known from DE-A1-10048376 and WO-A1-2004/081390. A normally closed valve is to be taken as a valve which is closed when unactuated.

DE-A1-10048376 discloses a normally closed self-blocking valve in which a positive pressure at a valve inlet has a closing effect. The valve includes a piezoceramic, wherein applying a voltage to the piezoceramic results in the valve opening. The self-blocking function, also with a positive pressure at the inlet, and the simple setup are advantages of such a valve. When such a valve is to be combined with a pump in order to avoid free flow, increased space and cost requirements will result due to the separate component required. Additionally, separate piezo-actuation is needed. Furthermore, a zero-level for the piezo/silicon diaphragm must be insured even after the step of gluing the piezoceramic to the silicon diaphragm, even if temperature changes result in a movement of the piezoceramic and silicon diaphragm arrangement. Additionally, such an arrangement would result in a large dead volume between valve and pump, additionally requiring fluidic fittings or connections therebetween.

WO-A1-2004/081390 teaches a double normally closed microvalve the valve outlet of which is coupled fluidically to the inlet of a downstream micropump. The valve is formed in a valve chip which itself has a self-blocking function when a positive pressure is applied to the inlet of the valve which itself has a self-blocking function when a positive pressure is applied to the outlet of the valve, and the valve of which opens when a negative pressure is applied to the outlet. When the pump is switched on, it generates a negative pressure at the pump inlet and the valve outlet, thereby opening the valve. Such a microvalve provides a self-blocking function, comprises passive components so that no piezo actuation is needed, and thus exhibits very good device-to-device reproducibility. Nevertheless, separate components are needed, resulting in additional space and cost requirements. Additionally, such double normally closed microvalves have only been available in silicon, which is expensive. Additionally, when being connected to a micropump, there is a large dead volume and fluidic fittings are needed. In addition, with high inlet pressures, the pump may not generate that negative pressure needed in order to open the valve fluidically connected to the inlet.

WO-A1-2004/081390 teaches a micropump having an integrated double normally closed microvalve. Such a micropump is of a compact design and exhibits a small dead volume. However, only small flow rates can be achieved using micropumps of this kind when the design of the pump is designed for a sufficiently high compression ration. Furthermore, the pump chip needed is large, and with high inlet pressures, the pump may not achieve that negative pressure needed in order to open the integrated double normally closed microvalve.

A medication delivery device comprising a pump and a safety valve at the outlet of the pump is known from WO-A-03/099351. One embodiment of this document teaches a diaphragm pump comprising passive ball check valves at a pump inlet and a pump outlet. A safety valve comprising a valve seat and a diaphragm acting as a valve flap is provided at the pump outlet. An area of this diaphragm is connected to an inlet reservoir of the pump arrangement via a fluidic connection so that a pressure in this inlet reservoir acts on that side of the diaphragm. The other surface of the diaphragm is connected to the pressure generated in a pump chamber of the pump via the check valve at the outlet of the pump.

In accordance with WO-A-03/099351, when the pump is switched off, the safety valve is pressure-balanced over nearly the entire size of the diaphragm, but not in the region inside the safety valve seat. The advantage of a safety valve connected in series to the outlet of a micropump is that a positive pressure at the pump inlet has a closing effect on the safety valve. When the pump is in operation, a relatively small positive pressure generated at the pump outlet can open the safety valve. The pump arrangements described in WO-A-03/099351, however, are of disadvantage in that separate components are needed, which in turn results in increased space and cost requirements. Additionally, the pump arrangements exhibit a large dead volume, wherein again fluidic fittings are needed.

Consequently, there is demand for a pump arrangement in which free flow can be prevented in an unactivated state and which comprises a simple setup and provides a small dead volume.

SUMMARY

According to an embodiment, a pump arrangement may have a pump having a pump inlet and a pump outlet configured to pump a fluid from the pump inlet to the pump outlet; a safety valve arranged between the pump outlet and an outlet of the pump arrangement and having a valve seat and a valve lid; wherein the valve lid is formed in a second integrated part of the pump arrangement, wherein an inlet of the pump arrangement and a fluid region fluidically connected thereto are formed in a third part of the pump arrangement, and wherein the second integrated part is arranged between a first integrated part and the third part of the pump arrangement, wherein a pressure in the fluid region has a closing effect on the safety valve, and wherein the pump inlet and the inlet of the pump arrangement are connected fluidically, wherein the valve seat, the pump outlet and the pump inlet are patterned in a first surface of the first integrated part of the pump arrangement.

In accordance with embodiments of an inventive pump arrangement, a safety valve is integrated directly to a pump. In order to allow a simple setup exhibiting a small dead volume, the valve seat of the safety valve, the pump outlet and the pump inlet are patterned in a first surface of an integrated part of the pump arrangement. Due to the fact that the outlet of the pump and the valve seat are formed in the same surface of an integrated part, the valve seat of the safety valve may be formed directly at the outlet of the pump, thereby achieving a small dead volume apart from a simple set up. In embodiments of the invention, the pump inlet is additionally patterned in the same surface and fluidically connected to a fluid region of the pump arrangement having a closing effect on the safety valve. This allows implementing the inventive pump arrangement with a simple setup.

In embodiments of the invention, the second integrated part of the pump arrangement is a layer of basically uniform thickness arranged between the first integrated part and the third part and separating same. This second integrated part may comprise at least one opening via which the pump inlet is fluidically connected to the fluid region representing an inlet fluid region of the pump arrangement. In embodiments in which an outlet fluid region of the pump arrangement is also formed in the third part, the second integrated part may comprise another opening by which an outlet of the safety valve is fluidically connected to the outlet of the pump arrangement. A second integrated part of basically uniform thickness which, as has been described, may be provided with openings allows easy manufacturing of an inventive pump arrangement comprising a reduced number of elements. In alternative embodiments, the second integrated part may be formed in the region of the safety valve only.

Embodiments of inventive pump arrangements may be implemented using different pumps, such as, for example, diaphragm pumps comprising passive check valves at the pump inlet and at the pump outlet, or peristaltic pumps. Embodiments of the present invention are particularly suitable for implementing micropumps in which a pump volume pumped during one pump cycle may be in the range of microliters and below. Furthermore, relevant dimensions of such a micropump, such as, for example, the pump stroke of a pump diaphragm or the thickness of a pump diaphragm, may be in the range of micrometers.

The present invention provides a pump arrangement wherein a pump and a safety valve are integrated in one element which may be implemented using a small number of parts. Embodiments of the invention may implement a pump arrangement element being formed of five or six individual parts or layers, thus considering a pump diaphragm part including the respective piezoceramic and corresponding fittings or connections as one part.

Embodiments of the present invention provide a pump arrangement chip formed of several patterned layers arranged one above the other which form a pump and a safety valve integrated at the pump outlet. Thus, embodiments of the invention do not necessitate separate fluidic connections between pump and valve. Both dead volume and space requirements can be minimized in embodiments of the invention. Apart from an easy implementation, embodiments of the invention allow size, weight and cost savings.

In accordance with embodiments of the inventive pump arrangement, a positive pressure at the pump arrangement inlet has a closing effect on the safety valve so that a flow in the direction from the inlet to the outlet may be avoided effectively in an unactuated state.

The above and other elements, features, steps, characteristics and advantages of the present invention will become more apparent from the following detailed description of the preferred embodiments with reference to the attached drawings.

BRIEF DESCRIPTION OF THE DRAWINGS

Embodiments of the invention will be detailed subsequently referring to the appended drawings, in which.

DETAILED DESCRIPTION OF THE INVENTION

Figure 1A:
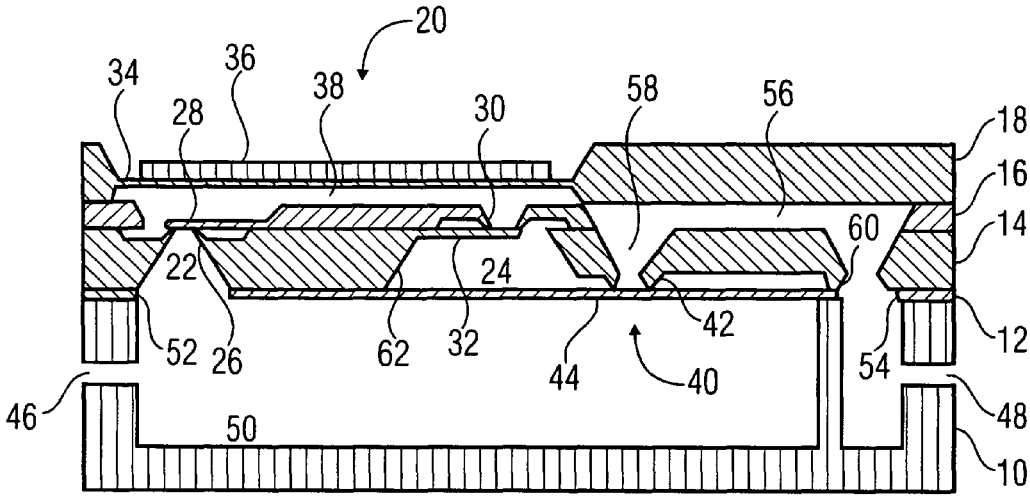
FIG. 1*a* shows a schematic cross sectional view of an embodiment of an inventive pump arrangement.
Figure 1B:
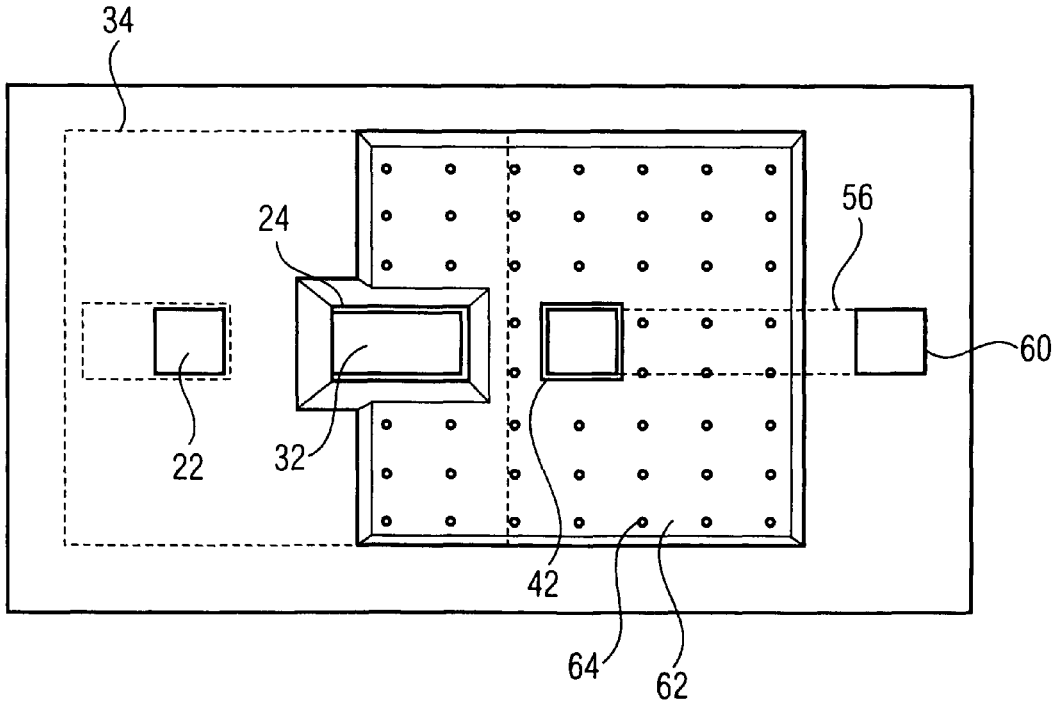
FIG. 1*b* shows a bottom view of a pump part of the embodiment shown in FIG. 1*a;*

Referring to FIGS. 1*a* and 1*b*, an embodiment of an inventive pump arrangement wherein a pump is implemented by a micro-diaphragm pump comprising passive check valves will be described below.

In accordance with the embodiment shown in FIGS. 1*a* and 1*b*, the pump arrangement includes five patterned layers which are arranged one above the other and attached to one another. These layers will subsequently be referred to as first layer 10, second layer 12, third layer 14, fourth layer 16 and fifth layer 18.

The pump arrangement shown in FIG. 1*a* comprises a diaphragm pump 20 comprising a pump inlet 22 and a pump outlet 24. The pump inlet 22 and the pump outlet 24 are patterned in the bottom surface of the third layer 14. The diaphragm pump 20 includes a passive check valve comprising a valve seat 26 and a valve flap 28, at the pump inlet 22. The valve seat 26 is patterned in the top surface of the third layer 14 and the valve flap 28 is patterned in the fourth layer 16. Additionally, the micropump 20 includes a passive check valve comprising a valve seat 30 and a valve flap 32, at the pump outlet 24. The valve seat 30 is patterned in the fourth layer 16 and the valve flap 32 is patterned in the top surface of the third layer 14.

Furthermore, the diaphragm pump 20 includes a pump diaphragm 34 patterned in the fifth part 18. A piezoceramic 36 is attached to the pump diaphragm 34 such that, by actuating same, a volume of a pump chamber 38 of the diaphragm pump 20 can be varied. For this purpose, suitable means (not shown) for applying a voltage to the piezoceramic 26 using which the pump diaphragm 34 may be deflected from the position as shown in FIG. 1*a* to a position where the volume of the pump chamber 38 is reduced are provided.

The embodiment of an inventive pump arrangement shown in FIG. 1*a* comprises a safety valve 40 at the pump outlet 24. The safety valve 40 includes a safety valve seat 42 and a safety valve flap 44. The safety valve seat 42 is patterned in the bottom surface of the third layer 14. The safety valve flap 44 is formed by a part of the second layer 12 opposite the safety valve seat 42. The third layer 14 comprises a recess 62 which defines the moveable part of the second layer 12 in the bottom surface thereof.

The pump arrangement shown in FIG. 1*a* includes a pump arrangement inlet 46 and a pump arrangement outlet 48. The pump arrangement inlet 46 is connected to a fluid region 50. The pump arrangement inlet 46, the pump arrangement outlet 48 and the fluid region 50 are patterned in the first layer 10. The fluid region 50 thus abuts on the bottom of the second layer 12 such that a pressure in the fluid region 50 has a closing effect on the safety valve 40. The fluid region 50 and thus the pump arrangement inlet 46 are fluidically connected to the pump inlet 22 via a first opening 52 in the second layer 12. The pump outlet 48 is fluidically connected to a fluid channel 56 via a second opening 54 in the second layer 12, said fluid channel in turn being fluidically connected to the safety valve 40 or an outlet of the safety valve. In the embodiment shown, the fluid channel 56 is formed by corresponding patternings in the third layer 14 and the fourth layer 16. The outlet of the safety valve is patterned in the top surface of the third layer 14.

The pump arrangement inlet 46 and the pump arrangement outlet 48 may be provided with suitable fluid connectors which allow connecting further fluidic structures, such as, for example, so-called Luer connectors for connecting tubes and the like.

FIG. 1*b* shows the patterns formed in the bottom of the third layer 14 which include the pump inlet 22, the pump outlet 24, the safety valve seat 42 and an outlet-side end 60 of the fluid channel 56 patterned in the bottom surface of the third layer 14. The fluid channel 56 is indicated in FIG. 1*b* in broken lines. The valve flap 32 of the check valve at the outlet of the micropump can be seen above the pump outlet 24 in FIG. 1*b*. In addition, the position and arrangement of the pump diaphragm 34 are indicated in FIG. 1*b* in broken lines. The recess represents a safety valve chamber 62 which is patterned in the bottom of the third layer 14 and in the embodiment illustrated comprises a basically square shape.

In order to support the second layer 12 in the region of the safety valve, an optional spacer structure 64 which is indicated in FIG. 1*b* by evenly distributed supports, may be provided. This spacer structure which is not shown in FIG. 1*a* may be formed by projections in the third layer 14 which may be of the same height as the safety valve seat 42. The projections may be manufactured using the same method steps, exemplarily the same etching step, as the safety valve seat 42. The spacer structure may be configured to reduce or basically prevent bending of the safety valve flap in the direction towards the third layer 14 in the case of a positive pressure at the pump arrangement inlet 46. This allows leaks caused by the safety valve flap 44 bending to be prevented. Furthermore, the diaphragm which forms the safety valve flap 44 is subjected to smaller voltages, thereby increasing durability thereof.

With the pump arrangement in operation, as is shown in FIGS. 1*a* and 1*b*, the pump diaphragm 34 is actuated departing from the state shown in FIG. 1*a* so that the volume of the pump chamber 38 is decreased. This generates a positive pressure in the pump chamber 38 which, on the one hand, opens the check valve at the pump outlet 24, and on the other hand, exerts pressure on the safety valve flap 44. At the same time, the positive pressure in the pump chamber 38 has a closing effect on the check valve at the inlet of the pump chamber. Thus, during actuation of the pump diaphragm 34, which is referred to as pump stroke, fluid is conveyed through the check valve at the pump outlet 24 and the safety valve 40 to the pump arrangement outlet 48.

In a subsequent suction stroke where the pump diaphragm 34 is brought back to the position shown in FIG. 1*a*, a negative pressure which has a closing effect on the check valve at the pump outlet 24 and an opening effect on the check valve at the pump inlet 22, forms in the pump chamber 38. Thus, during this suction stroke, fluid is sucked in through the pump arrangement inlet 46.

In order to effect a volume flow from the pump arrangement inlet to the pump arrangement outlet, the piezoceramic 36 can be provided with a voltage periodically, exemplarily by a pulsed square-wave voltage. Depending on the frequency of the actuating voltage applied and a stroke volume of the pump diaphragm 34, a desired delivery rate can be achieved.

When the pump 22 is not in operation, flow through the pump arrangement from the pump inlet 46 to the pump outlet 48 is prevented, since a positive pressure at the pump chamber inlet 46 acts on the bottom of the safety valve flap 44 via the fluid region 50 and at the same time acts on the top of the safety valve flap 44 via the pump 20, since this positive pressure has an opening effect on both check valves at the pump inlet 22 and at the pump outlet 24. The force acting on the safety valve flap 44 from below by the positive pressure at the inlet is greater than the force acting on it from above, so that a positive pressure at the inlet has a closing effect on the safety valve flap 44. The force acting from below is greater, since the pressure from below acts on a greater area than the pressure from above. More precisely, the pressure from below acts on the entire moveable flap area, whereas the pressure from above does not act on the region which is covered by the valve seat 42. Thus, in an unactuated state free flow can be prevented reliably with a positive pressure at the pump arrangement inlet.

Figure 2:
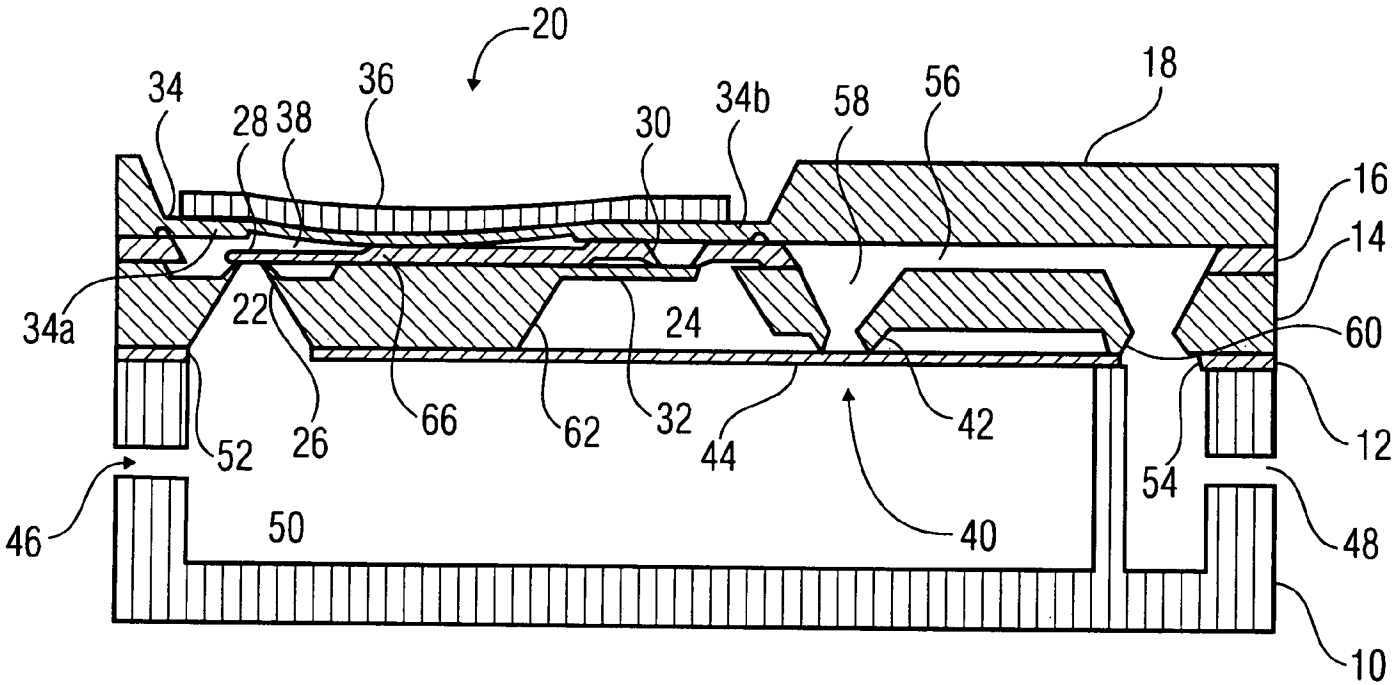
FIG. 2 shows a schematic cross sectional view of one modification of the embodiment shown in FIG. 1.

A modification of the embodiment shown in FIGS. 1*a* and 1*b* is shown in FIG. 2, same elements being referred to by same reference numerals and further description of these elements being omitted. As is shown in FIG. 2, the pump diaphragm 34 comprises elevations 34*a*, 34*b* projecting into the pump chamber, on the bottom. Additionally, the fourth layer 16 comprises an elevation 66 projecting into the pump chamber 38, compared to the example shown in FIG. 1*a*. In FIG. 2, the pump diaphragm 34 is shown in the actuated state. The elevations 34*a*, 34*b* may be formed in the edge region of the pump diaphragm 34*a*, 34*b*. The elevations 34*a*, 34*b* and 66 result in a decrease in the dead volume of the pump chamber 38, which in turn results in an increase in the compression ratio of the pump. The operation of the pump arrangement shown in FIG. 2 corresponds to the operation of the embodiment described before referring to FIGS. 1*a* and 1*b*.

Figure 3:
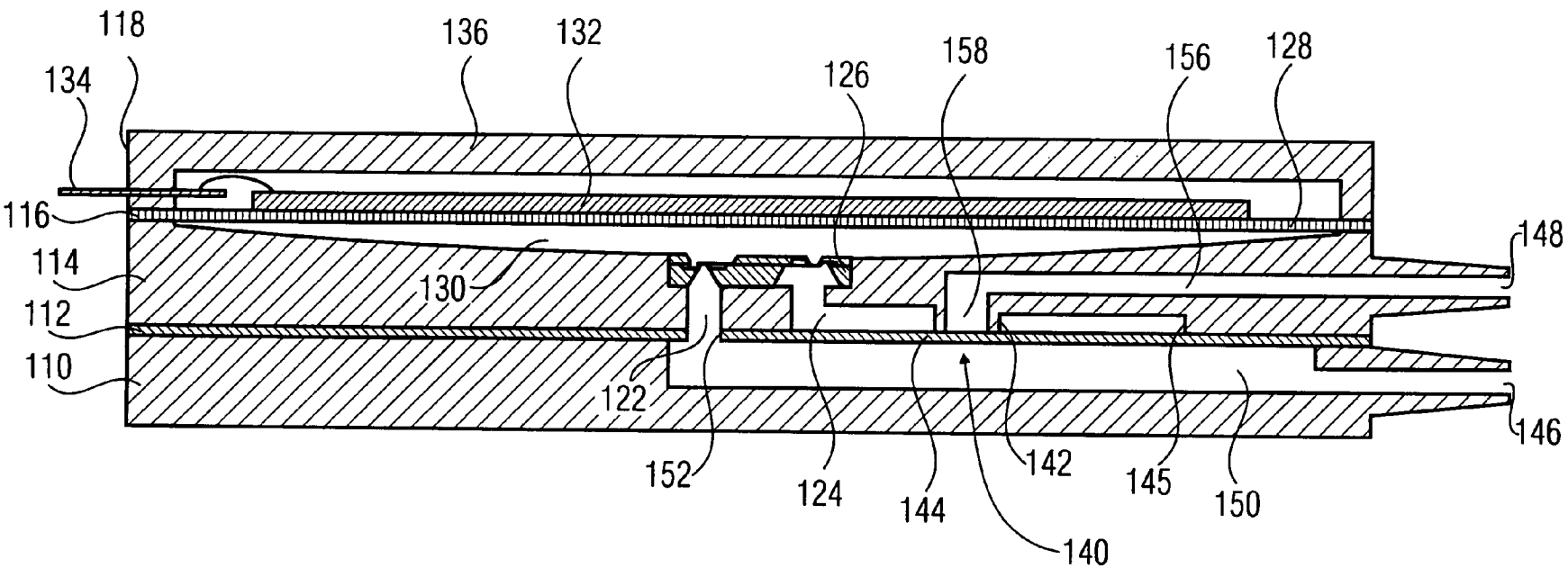
FIG. 3 shows a schematic cross sectional view of an alternative embodiment of an inventive pump arrangement.

Referring to FIG. 3, an alternative embodiment of an inventive pump arrangement will be described below. The pump arrangement shown in FIG. 3 includes five layers 110, 112, 114, 116 and 118 which are arranged one above the other and attached to one another. The pump arrangement includes a pump which comprises a pump inlet 122 and a pump outlet 124. The pump inlet 122 and the pump outlet 124 are patterned in the lower surface of the third layer 114. A recess in which a check valve module 126 is arranged is formed in the top surface of the third layer 114. The check valve module 126 may exemplarily be glued to the recess. The check valve module 126 may exemplarily comprise a setup as is described in DE-A-19719862.

The top face of the third layer 114 is additionally patterned so as to establish a pump chamber 130 together with the bottom of a pump diaphragm 128 which is formed by the fourth layer 116. The pump diaphragm 128 may exemplarily be formed by a metal layer, such as, for example, a stainless steel foil. A piezoceramic 132 is arranged on the pump diaphragm 128. A voltage for actuating the pump diaphragm 128 may be applied to the piezoceramic 132 via corresponding connecting means which are indicated schematically at 134. When actuated, the pump diaphragm 128 is deflected downwards so that the volume of the pump chamber 130 is reduced. As is shown in FIG. 3, the contour of the surface of the third layer 114 facing the pump diaphragm 128 is adapted to the contour of the pump diaphragm 128 in the deflected state so that a dead volume of the pump is decreased and thus a compression ratio thereof may be increased. In the example shown, a lid 136 which is formed by corresponding patterning of the fifth layer 118 is provided above the pump diaphragm 128.

The pump arrangement shown in FIG. 3 additionally includes a safety valve 140 which comprises a safety valve seat 142 and a safety valve flap 144. The safety valve flap 142 is patterned in the bottom of the third layer 114. The safety valve flap 144 is formed by a moveable part of the second layer 112. The moveable part of the second layer 112 in turn is defined by a corresponding recess in the bottom of the third layer 114.

The pump arrangement includes a pump arrangement inlet 146 and a pump arrangement outlet 148. The pump arrangement inlet 146 is patterned in the first layer 110 and fluidically connected to a fluid region 150 which is also patterned in the first layer 110. The fluid region 150 abuts on the bottom of the safety valve flap 144 such that a positive pressure at the inlet 146 has an effect on the bottom of the valve flap 144.

The pump arrangement outlet 148 is fluidically connected to an outlet 158 of the safety valve 140 via a fluid channel 156.

Like in the embodiments described before, the moveable safety valve flap 44 is not mounted to the valve seat 142 so that a positive pressure acting on the top side of the valve flap, compared to a pressure acting on the bottom of the valve flap, has an opening effect on the safety valve.

The check valve module 100 provides a check valve at the pump inlet 122 and a check valve 124 at the pump outlet. A positive pressure in the pump chamber 130 has a closing effect on the check valve at the pump inlet 122 and an opening effect on the check valve at the pump outlet 124, whereas a negative pressure in the pump chamber 130 has an opening effect on the check valve at the pump inlet 122 and a closing effect on the check valve at the pump outlet 124.

The pump arrangement inlet 146 and the pump arrangement outlet 148 in turn may be configured to allow fluid tubes or the like to be connected. As is shown in FIG. 3, the pump inlet 122 is fluidically connected to the fluid region 150 via an opening 152 in the second layer 112.

In the embodiment shown in FIG. 3, the fourth layer 116 may be formed by a metal foil having a piezoceramic applied thereon. The check valve module 126 may comprise patterned microvalves made of silicon. Such a combination advantageously allows implementing micropumps exhibiting a small setup and large delivery rate.

The operation of the pump arrangement shown in FIG. 3 basically corresponds to the operation described before referring to the embodiment shown in FIG. 1*a*. Again, a difference in pressure generated by a pump stroke in the pump chamber 130 has an opening effect on the safety valve flap 144 such that during such a pump stroke fluid from the pump chamber is delivered through the pump arrangement outlet 148. During a suction stroke in turn, fluid is sucked in through the pump arrangement inlet 146 and the check valve at the pump inlet 122, while the check valve at the pump outlet 126 is closed. When the pump is not operating, a pump positive pressure at the pump arrangement inlet 146 in turn has a closing effect on the bottom of the safety valve flap 144 such that in an unactuated state flow through the pump arrangement can be prevented reliably with a positive pressure at the inlet.

Figure 4:
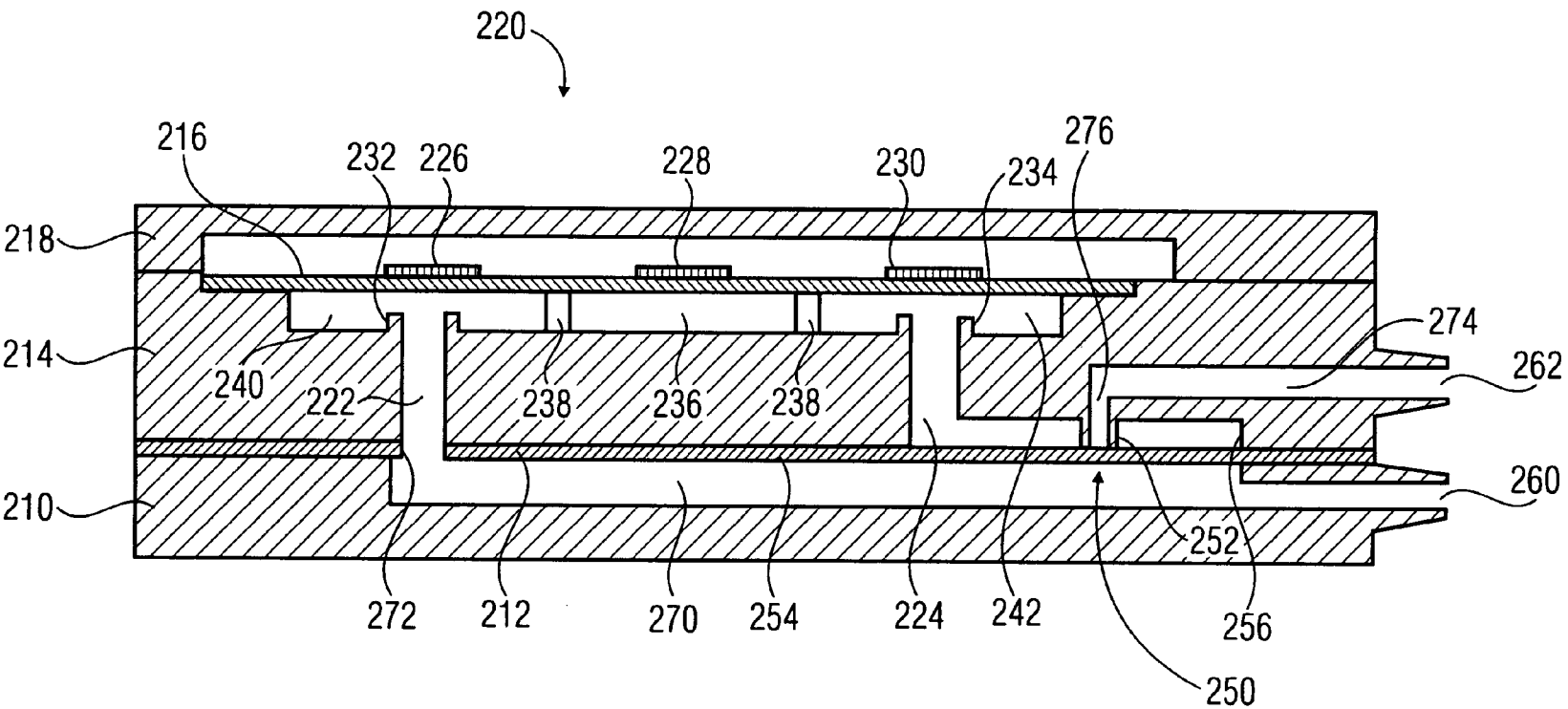
FIG. 4 shows a schematic cross sectional view of another alternative embodiment of an inventive pump arrangement.

Referring to FIG. 4, an alternative embodiment of an inventive pump arrangement which comprises a peristaltic micropump will be described.

The pump arrangement shown in FIG. 4 comprises a first layer 210, a second layer 212, a third layer 214, a fourth layer 216 and a fifth layer 218. The layers 210, 212, 214 and 218 are arranged one above the other and attached to one another. The layer 216 is attached to the layer 214 or, as is shown in FIG. 4, arranged in a recess formed in a top surface of the layer 214.

The pump arrangement shown in FIG. 4 comprises a peristaltic micropump 220 which comprises a pump inlet 222, a pump outlet 224, a pump diaphragm formed by the fourth layer 216, and three piezoelectric actuators 226, 228 and 230. An inlet valve seat 232 forms an active inlet valve together with a region of the diaphragm 216 opposite thereto, whereas an outlet valve seat 234 provides an active outlet valve together with a section of the diaphragm 216 opposite thereto. A central portion of the diaphragm 216 defines a pump chamber 236 together with a top surface portion of the third layer 214. The pump chamber 236 is fluidically connected to an inlet valve chamber 240 and an outlet valve chamber 242 via fluidic connections 238. This means that the setup of the peristaltic micropump may basically correspond to the setup of a peristaltic micropump, as is described in DE-A-10238600.

The piezoelectric actuators 226, 228 and 230 are connected to voltage sources and/or control means (which are not shown) via corresponding electrical connections (not shown). This allows actuating and deflecting downwards the individual diaphragm sections of the diaphragm 216 in a specific order so as to effect a pump action from the pump inlet 222 to the pump outlet 224, as is exemplarily described in DE-A-10238600, the corresponding teaching thereof being incorporated herein by reference.

The pump arrangement shown in FIG. 4 comprises a safety valve 250 which comprises a safety valve seat 252 and a safety valve flap 254, at the pump outlet 224 of the pump 220. The safety valve seat 252 is formed in the bottom surface of the third layer 214, whereas the safety valve flap 254 is formed by a moveable part of the second layer 212. The moveable part of the second layer 212 is defined by a recess 256 in the bottom of the third layer 214.

The pump arrangement includes a pump arrangement inlet 260 and a pump arrangement outlet 262. The pump arrangement inlet 260 is fluidically connected to a fluid region 270 which is connected to the pump inlet 222 via an opening 272 in the second layer 212. The fluid arrangement outlet 262 is fluidically connected to an outlet 276 of the safety valve 250 via a fluid channel 274.

The fifth layer 218 is patterned so as to provide a lid for protecting the diaphragm 216 and the piezoelectric actuators 226, 228 and 230 arranged thereon, and the respective electrical connections.

In operation, the sections of the diaphragm 216 can be operated as is described in DE-A-10238600. A positive pressure caused in the pump chamber 236 during a pump stroke thus opens the safety valve 250 which is fluidically connected to the pump outlet 224.

When the pump 220 is not operated, a positive pressure at the pump arrangement inlet 260 in turn has a closing effect on the safety valve 250.

Thus, the present invention provides pump arrangements in which fluid flow from the inlet to the outlet can be prevented reliably with a positive pressure at the inlet, comprising a simple setup, using a small number of elements, and a small dead volume.

The different parts and/or layers of embodiments of the inventive pump arrangements may be implemented using any suitable materials using any suitable manufacturing methods. Exemplarily, the parts may be made of silicon, wherein corresponding patternings may be generated by wet-etching (isotropically) or dry-etching (anisotropically). Alternatively, the parts may be made of plastics and be manufactured by injection molding methods. Exemplarily, the layers 12, 14, 16 and 18 may be patterned from silicon. The second layers 12, 112 and 212 may exemplarily be made of an elastic material, such as, for example, correspondingly thin silicon or rubber. The first layers 10, 110 and 210, the third layers 114 and 214 and the fifth layers 118 and 218 may exemplarily be formed from plastics by injection molding. The diaphragm 216 may exemplarily be made of silicon or another suitable material so as to realize respective piezoelectric bending converters together with the actuators 226, 228 and 230.

Inventive pump arrangements are suitable for a plurality of applications. Subsequently, only exemplarily, applications wherein preventing free flow with a positive pressure at the pump inlet is important will be mentioned. Such applications embodiments of inventive pump arrangements are suitable for, exemplarily include methanol feed pumps in fuel cell systems, infusion pumps, implantable drug delivery systems, portable drug delivery systems, systems for moistening respiratory air, and systems for dosing anaesthetics.

A peristaltic micropump comprising normally open valves, as is shown in FIG. 4, allows implementing a pump having a high compression ratio, which in turn is of advantage for a bubble-tolerant operation. Alternatively, an inventive pump arrangement may also comprise a peristaltic micropump comprising normally closed active valves at the pump inlet and/or the pump outlet.

Instead of only one recess and only one check valve module, two separate recesses may be provided in the top surface of the third layer 114, wherein a check valve module for a check valve at the pump inlet may be attached to a first recess and a second check valve module having a check valve for the pump outlet may be attached to a second recess.

The components of embodiments of the inventive pump arrangement, such as, for example, the second layer 12 and the third layer 14, may be connected to one another using any known joining techniques, such as, for example, by gluing, clamping or connecting methods not having a joining layer.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

The invention claimed is:

1. A pump arrangement comprising:

a pump comprising a pump inlet and a pump outlet which is configured to pump a fluid from the pump inlet to the pump outlet;

a safety valve arranged between the pump outlet and an outlet of the pump arrangement and comprising a valve seat and a valve lid;

wherein the valve lid is formed in a second integrated part of the pump arrangement, wherein an inlet of the pump arrangement and a fluid region fluidically connected thereto are formed in a third part of the pump arrangement, wherein the second integrated part is arranged between a first integrated part and the third part of the pump arrangement, wherein a pressure in the fluid region comprises a closing effect on the safety valve, and wherein the pump inlet and the inlet of the pump arrangement are connected fluidically, wherein the valve seat, the pump outlet and the pump inlet are patterned in a first surface of the first integrated part of the pump arrangement, wherein the pump is a diaphragm pump comprising passive check valves, and wherein a valve seat of one of the passive check valves at the pump inlet and a valve flap of one of the passive check valves at the pump outlet are patterned in a second surface of the first integrated part opposite the first surface of the first integrated part.

2. The arrangement in accordance with claim 1, wherein the pump inlet and the inlet of the pump arrangement are connected fluidically via an opening in the second integrated part.

3. The pump arrangement in accordance with claim 1, further comprising a fourth part of the pump arrangement, the first integrated part being arranged between the fourth part and the second integrated part of the pump arrangement, and a valve flap of the check valve at the pump inlet and a valve seat of the check valve at the pump outlet being patterned in a first surface of the fourth part facing the first integrated part.

4. The pump arrangement in accordance with claim 3, further comprising a fifth part, the fourth part being arranged between the first integrated part and the fifth part, and a pump diaphragm of the pump being patterned in the fifth part.

5. The pump arrangement in accordance with claim 1, wherein the first integrated part comprises one or more recesses in a second surface thereof opposite the first surface, wherein one or more check valve modules comprising a check valve for the pump inlet and a check valve for the pump outlet are attached to the one or more recesses.

6. The pump arrangement in accordance with claim 1, wherein the diaphragm pump comprises a metal diaphragm and check valves made of silicon.

7. The pump arrangement in accordance with claim 1, wherein the pump is a peristaltic micropump.

8. The pump arrangement in accordance with claim 1, wherein the second integrated part comprises a layer of uniform thickness arranged between the first integrated part and the third part in which one or more openings are formed, wherein the second integrated part separates the first integrated part and the third integrated part completely.

9. The pump arrangement in accordance with claim 1, wherein the outlet of the pump arrangement is formed in the third part or in the first integrated part.

10. The pump arrangement in accordance with claim 1, wherein the safety valve comprises spacers which reduce bending of the valve lid with a positive pressure in the fluid region.

11. A pump arrangement comprising:

a pump comprising a pump inlet and a pump outlet which is configured to pump a fluid from the pump inlet to the pump outlet;

a safety valve arranged between the pump outlet and an outlet of the pump arrangement and comprising a valve seat and a valve lid;

wherein the valve lid is formed in a second integrated part of the pump arrangement, wherein an inlet of the pump arrangement and a fluid region fluidically connected thereto are formed in a third part of the pump arrangement, wherein the second integrated part is arranged between a first integrated part and the third part of the pump arrangement, wherein a pressure in the fluid region comprises a closing effect on the safety valve, and wherein the pump inlet and the inlet of the pump arrangement are connected fluidically, wherein the valve seat, the pump outlet and the pump inlet are patterned in a first surface of the first integrated part of the pump arrangement, and wherein at least portions of a pump chamber are patterned in a second surface of the first integrated part opposite the first surface thereof, and wherein a pump diaphragm is provided so as to abut on the pump chamber.

12. The pump arrangement in accordance with claim 11, wherein a contour of wall sections of the pump chamber which are opposite the pump diaphragm is adapted to a contour of the pump diaphragm in a deflected state.

13. The pump arrangement in accordance with claim 11, wherein the pump diaphragm comprises elevations projecting in the pump chamber.

14. A pump arrangement comprising:

a pump comprising a pump inlet and a pump outlet which is configured to pump a fluid from the pump inlet to the pump outlet;

a safety valve arranged between the pump outlet and an outlet of the pump arrangement and comprising a valve seat and a valve lid;

wherein the valve lid is formed in a second integrated part of the pump arrangement, wherein an inlet of the pump arrangement and a fluid region fluidically connected thereto are formed in a third part of the pump arrangement, wherein the second integrated part is arranged between a first integrated part and the third part of the pump arrangement, wherein a pressure in the fluid region comprises a closing effect on the safety valve, and wherein the pump inlet and the inlet of the pump arrangement are connected fluidically, wherein the valve seat, the pump outlet and the pump inlet are patterned in a first surface of the first integrated part of the pump arrangement, and wherein the pump is a diaphragm pump including a pump diaphragm arranged on a surface of the first integrated part that is opposite to the first surface thereof.

* * * * *

UNITED STATES PATENT AND TRADEMARK OFFICE

CERTIFICATE OF CORRECTION

PATENT NO. : 8,382,452 B2
APPLICATION NO. : 12/743831
DATED : February 26, 2013
INVENTOR(S) : Richter et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 348 days.

Signed and Sealed this
First Day of September, 2015

Michelle K. Lee

Michelle K. Lee
*Director of the United States Patent and Trademark Office*